US009867507B2

(12) United States Patent
Toh

(10) Patent No.: US 9,867,507 B2
(45) Date of Patent: Jan. 16, 2018

(54) DISPENSER

(71) Applicant: COLGATE-PALMOLIVE COMPANY, New York, NY (US)

(72) Inventor: Kiat-Cheong Toh, Forest Hills, NY (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 0 days.

(21) Appl. No.: 14/923,909

(22) Filed: Oct. 27, 2015

(65) Prior Publication Data

US 2017/0112331 A1 Apr. 27, 2017

(51) Int. Cl.
*A47K 5/14* (2006.01)
*A47K 5/12* (2006.01)
(Continued)

(52) U.S. Cl.
CPC ..... *A47K 5/14* (2013.01); *A47K 5/12* (2013.01); *A47K 5/1211* (2013.01); *B05B 11/0054* (2013.01); *B05B 11/0097* (2013.01); *B05B 11/3081* (2013.01); *A47K 5/1205* (2013.01); *B05B 7/30* (2013.01); *B05B 11/0056* (2013.01);
(Continued)

(58) Field of Classification Search
CPC ..... B65D 83/66; B65D 83/68; B65D 83/682; B65D 83/0044; A47K 5/14; A47K 5/16; A47K 5/18; A47K 5/1202; A47K 5/1204; A47K 5/1207; A47K 5/1211; A47K 5/12; A47K 5/121; B05B 7/30; B05B 11/0054; B05B 11/0097; B05B 11/3081; B05B 11/0051; B05B 11/0056; B05B 11/007; B05B 11/0072; B05B 11/0075; B05B 11/0078; B05B 11/3028–11/3029; B05B 11/3046–11/3047; B05B 11/3083–11/3085
USPC ..... 222/135–137, 190, 325–327, 183, 222/145.5–145.6, 383.1, 401, 192; 137/205.5, 888; 239/308, 310
See application file for complete search history.

(56) References Cited

U.S. PATENT DOCUMENTS 3,029,837 A * 4/1962 Neudeck ..... A01C 23/042 137/564.5
3,198,438 A * 8/1965 Hultgren ..... A01C 23/042 137/205.5
(Continued)

OTHER PUBLICATIONS

Can Your Bottle Do This? https://www.youtube.com/watch?v=AZmO3Pw6ka8, date unknown but prior to the date of the application, screenshots of 30 second video, 11 pp.
(Continued)

*Primary Examiner* — Paul R Durand
*Assistant Examiner* — Andrew P Bainbridge

(57) ABSTRACT

A dispenser includes a housing defining an internal volume. A cartridge is coupled with the housing. A tube extends into the internal volume of the housing. A first liquid is drawn from the internal volume into the tube through a first inlet in the tube when the pump assembly is actuated. A connecting member is positioned in the internal volume of the housing and coupled to the cartridge and the tube. A second liquid is drawn from the cartridge, through the connecting member, and into the tube through a second inlet in the tube when the pump assembly is actuated.

19 Claims, 10 Drawing Sheets

(51) Int. Cl.

| | |
|---|---|
| ***B05B 11/00*** | (2006.01) |
| *B05B 7/30* | (2006.01) |
| *B65D 83/68* | (2006.01) |
| *B65D 83/66* | (2006.01) |

(52) U.S. Cl.
CPC ..... *B05B 11/0078* (2013.01); *B05B 11/3047* (2013.01); *B05B 11/3083* (2013.01); *B65D 83/66* (2013.01); *B65D 83/682* (2013.01)

(56) References Cited

U.S. PATENT DOCUMENTS 4,279,362 A 7/1981 Pursell
4,355,739 A * 10/1982 Vierkotter ..... B05B 11/3083 222/134
5,385,270 A * 1/1995 Cataneo ..... B05B 11/3083 222/134
5,711,457 A * 1/1998 Wanbaugh ..... B05B 11/3085 222/136
5,803,312 A * 9/1998 Credle, Jr. ..... B05B 11/0043 222/129.1
5,819,987 A * 10/1998 Miller ..... B05B 11/3081 222/135
5,848,732 A * 12/1998 Brugger ..... B05B 11/3083 222/137
5,944,223 A * 8/1999 Klima ..... B05B 11/0056 222/129
5,971,210 A * 10/1999 Brugger ..... B05B 11/3083 222/137
6,036,057 A * 3/2000 Poutiatine ..... B05B 11/0056 222/137
6,299,023 B1 * 10/2001 Arnone ..... B05B 11/3083 222/105
6,540,109 B1 * 4/2003 Klima ..... B05B 11/0056 222/83.5
7,118,012 B2 * 10/2006 Butler ..... B05B 11/0081 222/129
7,926,682 B2 * 4/2011 Nelson ..... B01F 15/0205 141/330
7,938,258 B2 * 5/2011 Saravanane ..... B05B 11/0081 206/219
8,857,738 B2 * 10/2014 Knopow ..... B05B 7/2443 222/144
8,925,766 B2 * 1/2015 Gray ..... A47K 5/1207 222/1
9,027,790 B2 * 5/2015 Ciavarella ..... A47K 5/14 222/129.2
9,192,949 B2 * 11/2015 Lang ..... B05B 11/0018
9,434,599 B2 * 9/2016 Freudenberg ..... B67D 7/3209
2001/0025859 A1 * 10/2001 Dumont ..... B05B 11/3081 222/136
2002/0113084 A1 * 8/2002 Gauthier ..... A47K 5/1217 222/65
2013/0193232 A1 * 8/2013 Dobias ..... A01M 7/0046 239/308
2017/0112330 A1 * 4/2017 Toh ..... A47K 5/14

OTHER PUBLICATIONS

My Clean Path, http://www.mycleanpath.com/, date unknown but prior to the date of the application, 12 pp.

* cited by examiner

DISPENSER

BACKGROUND

Hand soap is typically sold in a dispenser that includes a housing and a pump assembly. The hand soap is disposed within the housing. When a user actuates the pump assembly (e.g., by pressing downward), the soap flows out through a nozzle in the pump assembly as a (e.g., foaming) hand soap.

In another embodiment, the dispenser may be sold to the user with no soap inside. The user may pour a measured amount of concentrated soap into the housing through a first end of the housing, and pour a measured amount of water into the housing through a second end of the housing. The concentrated soap and water mix together in the housing. When a user actuates the pump assembly (e.g., by pressing downward), the mixture flows out through a nozzle in the pump assembly as a (e.g., foaming) hand soap. When the concentrated soap and water mixture is exhausted, the user may pour additional measured amounts of concentrated soap and water into the housing, so that the dispenser may continue to be used. What is needed, however, is an improved system and method for refilling a dispenser after the soap is exhausted.

BRIEF SUMMARY

A dispenser is disclosed. The dispenser includes a housing defining an internal volume. A cartridge is coupled with the housing. A tube extends into the internal volume of the housing. A first liquid is drawn from the internal volume into the tube through a first inlet in the tube when the pump assembly is actuated. A connecting member is positioned in the internal volume of the housing and coupled to the cartridge and the tube. A second liquid is drawn from the cartridge, through the connecting member, and into the tube through a second inlet in the tube when the pump assembly is actuated.

In another embodiment, the dispenser includes a housing defining an internal volume. A cartridge is coupled with the housing. A tube extends into the internal volume of the housing. A first liquid is drawn from the internal volume into the tube through a first inlet in the tube when the pump assembly is actuated. A connecting member is positioned in the internal volume of the housing fluidly connecting the cartridge to the tube. A second liquid is drawn from the cartridge, through the connecting member, and into the tube through a second inlet in the tube when the pump assembly is actuated. The cartridge includes a valve that prevents the second liquid from flowing out of the cartridge when the cartridge is decoupled from the connecting member.

A method for using a dispenser is also disclosed. The method includes pouring a first liquid into an internal volume of a housing. A tube of a pump assembly is inserted into the internal volume of the housing. The tube includes a first inlet and a second inlet that are positioned in the internal volume of the housing. A cartridge is coupled with the housing. A second liquid is disposed in the cartridge. The cartridge is coupled to a connecting member that is positioned within the internal volume of the housing. The connecting member is positioned between the second inlet of the tube and the cartridge.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Figure 1:
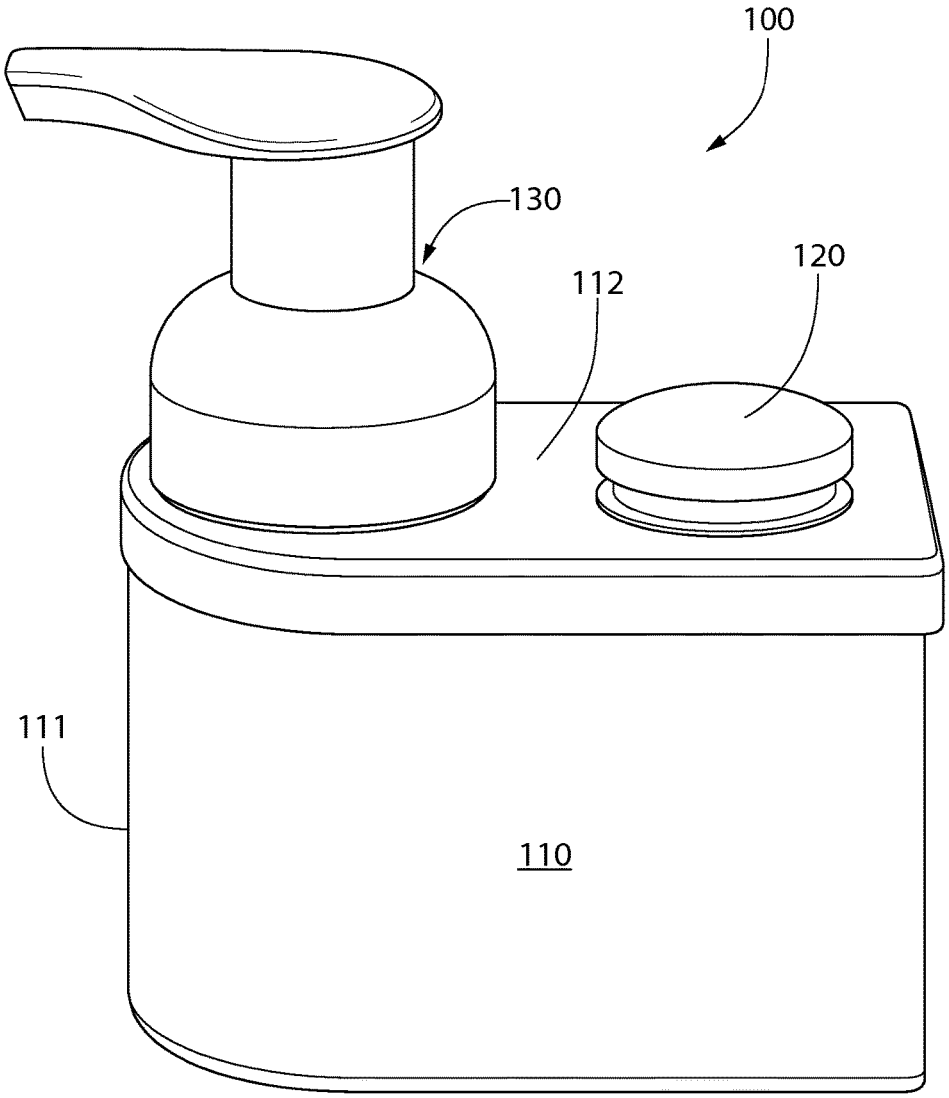
FIG. 1 depicts a perspective view of an example of a dispenser including a housing, a cartridge, and a pump assembly.
Figure 2:
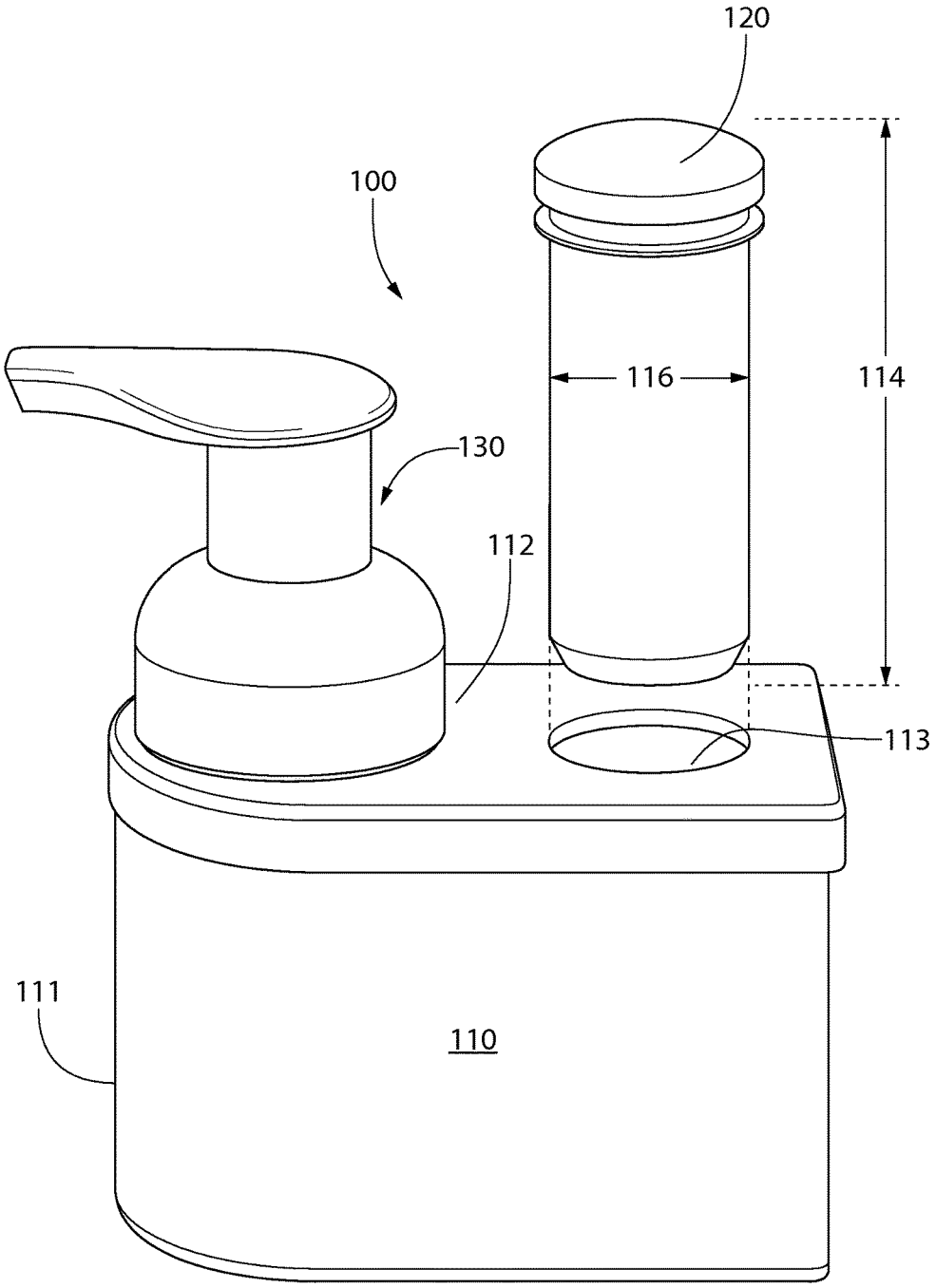
FIG. 2 depicts a perspective view of the dispenser of FIG. 1 showing the cartridge being inserted into the housing.

FIG. 1 depicts a perspective view of an example of a dispenser 100 including a housing 110, a cartridge 120, and a pump assembly 130, and FIG. 2 depicts a perspective view of the dispenser 100 showing the cartridge 120 being inserted into the housing 110. Although the dispenser 100 is described below as a foaming hand soap dispenser, in other embodiments, the dispenser 100 may be used to dispense other liquids, such as body wash, facial cleanser, hair care or styling products, surface cleaner detergents, hand sanitizers, skin moisturizers, cosmetic or therapeutic skin products, or the like.

The housing 110 may have a substantially rectangular cross-sectional shape. As shown, one side 111 of the housing may be curved or rounded. The housing 110 may define an internal volume. As described in more detail below, a first liquid may be disposed in the internal volume of the housing 110. The first liquid may be or include water, surfactant, or a combination thereof.

A lid 112 may be removably coupled to an open, upper end of the housing 110. In another embodiment, the lid 112 may be integral with the housing 110 (e.g., via blow-molding). The lid 112 may have one or more openings formed therethrough (two are shown). The cartridge 120 may be inserted at least partially into the internal volume of the housing 110 through the first opening 113 in the lid 112. Once inserted into the internal volume, the cartridge 120 may be coupled to the lid 112 to form a "water-tight" seal. In at least one embodiment, the cartridge 120 may be coupled to the lid 122 via a friction fit, a spring-assisted friction fit, snap geometry (e.g., a bead, a nesting hemisphere, etc.), a thread or bayonet-style turn-to-lock feature, or a combination thereof. In at least one embodiment, a seal may be coupled to the lid 112 and/or the cartridge 120 to form a liquid-tight seal between the two components.

In at least one embodiment, the cartridge 120 may have a substantially cylindrical shape. As shown, the cartridge 120 may have the shape of a test tube. As such, a height of the cartridge 120 may be from about 125% to about 500%, from about 500% to about 1000%, or from about 1000% to about 2000% greater than a width 116 of the cartridge 120. The cartridge 120 may define an internal volume having a second liquid disposed therein. The second liquid may be or include a concentrated soap, a fragrance, an anti-bacterial liquid, a moisturizer, or a combination thereof.

In at least one embodiment, the outer surface of the cartridge 120 may have an active ingredient disposed thereon. The active ingredient may be or include one or more of the following: bleaches, ionized silver, formaldehyde donors (e.g., DMDM hydantoin), organic acids (e.g. lactic acid), quaternary ammonium compounds, isothiazolinones, phenoxyethanol, or the like. When the cartridge 120 is inserted into the internal volume of the housing 110, at least a portion of the cartridge 120 may be in contact with the first liquid (e.g., water) in the internal volume of the housing 110. This may allow the active ingredient to mix with the first liquid to prevent micro-organism growth in the first liquid. In another embodiment, the active ingredient may be disposed on the inner surface of the housing 110.

The pump assembly 130 may be inserted at least partially into the internal volume of the housing 110 through the second opening in the lid 112. Once inserted into the internal volume, the pump assembly 130 may be coupled to the lid 112 via a screw thread, a bayonet-style twist lock, a press fit, a hinged latch, an elastomeric seal, or a combination thereof. This may form a "water-tight" seal between the lid 112 and the pump assembly 130. The lid 112 is, in turn, coupled to the housing 110 via a screw thread, a bayonet-style twist lock, a press fit, a hinged latch, an elastomeric seal (with or without vacuum assist), or a combination thereof. This may form a "water-tight" seal between the lid 112 and the housing 110. In at least one embodiment, the opening in the lid 112 through which the pump assembly 130 is inserted may be used to provide access to clean the inside of the housing 110.

Figure 3:
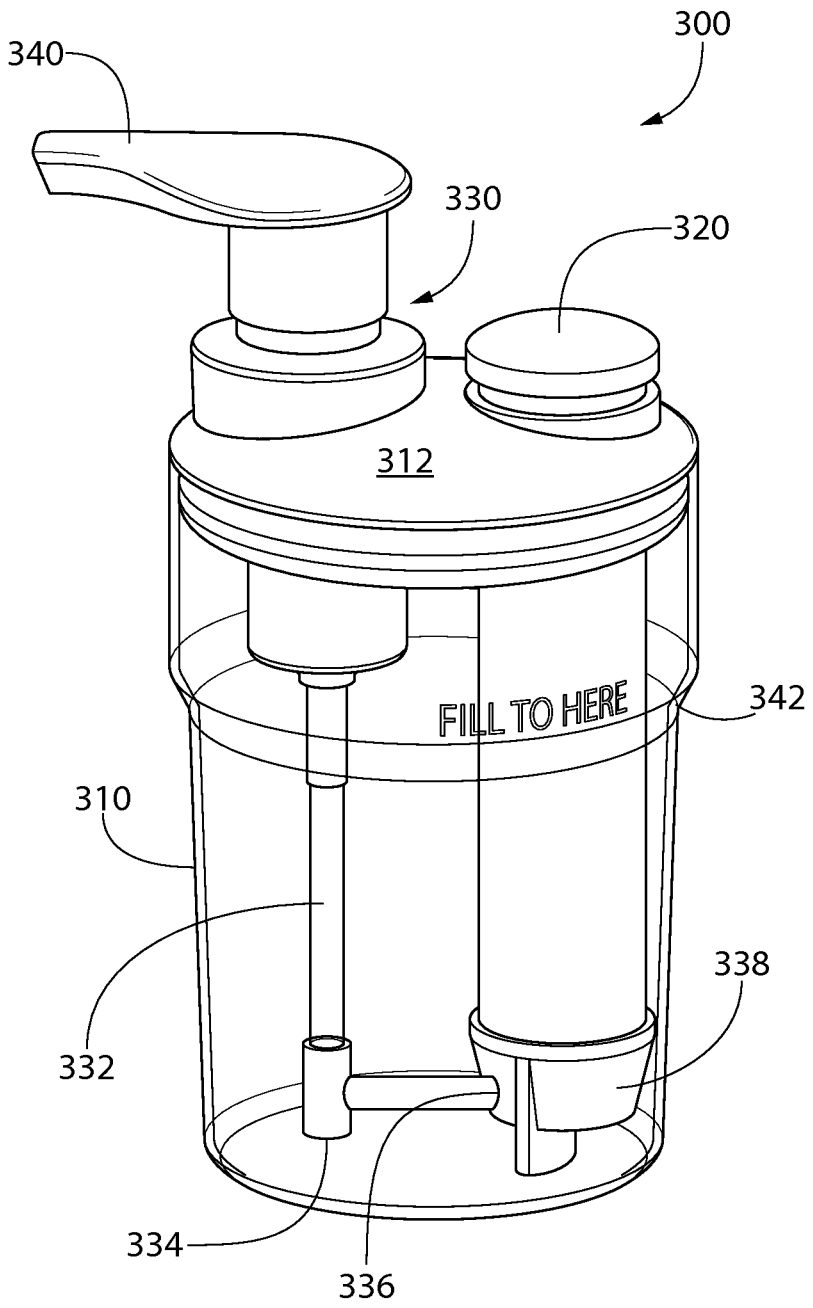
FIG. 3 depicts a perspective view of an example of another dispenser including a housing, a cartridge, and a pump assembly.
Figure 4:
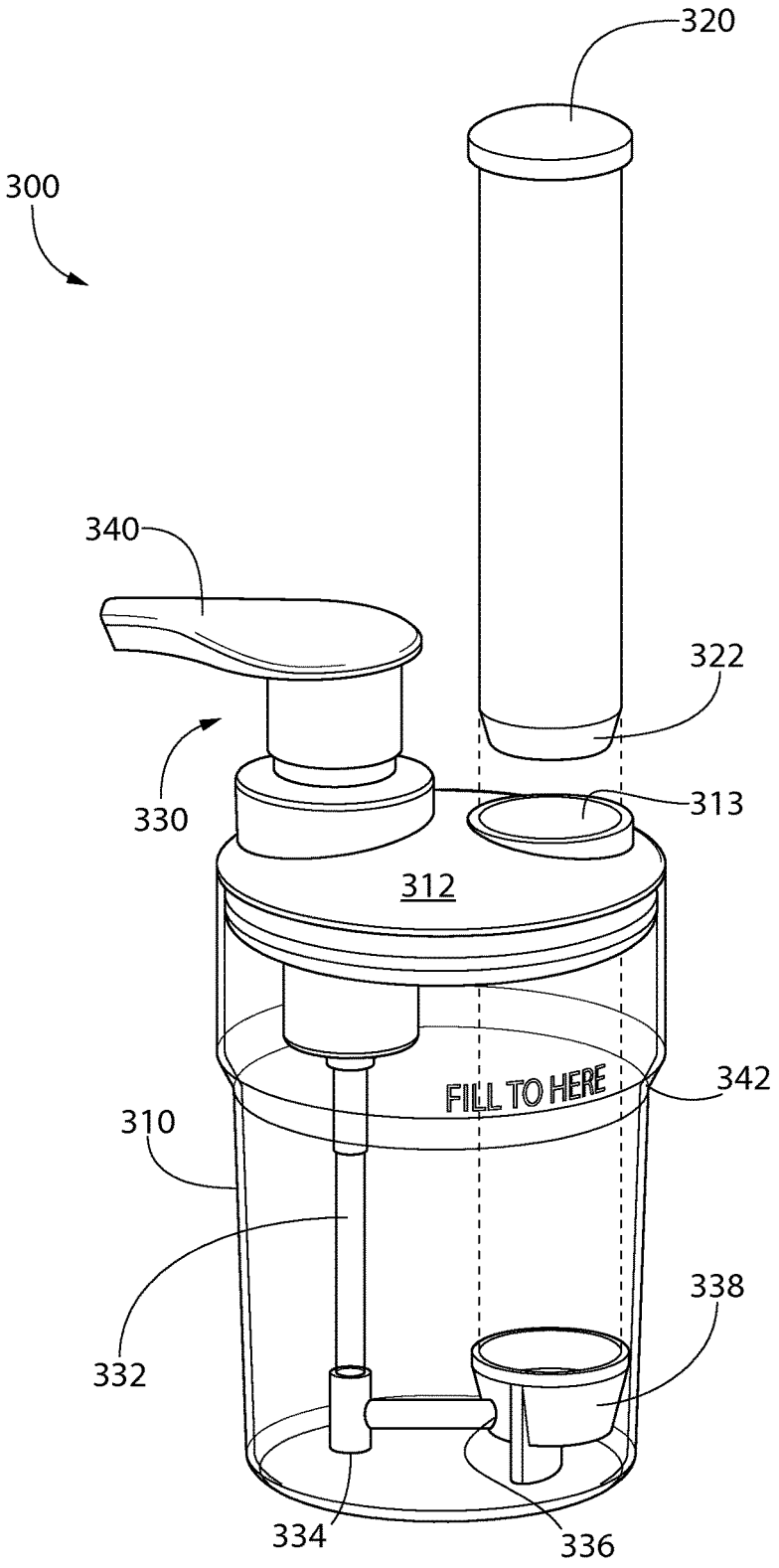
FIG. 4 depicts a perspective view of the dispenser of FIG. 3 showing the cartridge being inserted into the housing.

FIG. 3 depicts a perspective view of an example of another dispenser 300 including a housing 310, a cartridge 320, and a pump assembly 330, and FIG. 4 depicts a perspective view of the dispenser 300 of FIG. 3 showing the cartridge 320 being inserted into the housing 310. In the embodiment shown, the housing 310 may have a substantially circular cross-sectional shape. In addition, the housing 310 may be at least partially transparent or opaque.

The pump assembly 330 may include a tube 332 that extends into the internal volume of the housing 310. As shown, neither the cartridge 320 nor the tube 332 may be concentric with the housing 310 or the lid 312; however, in other embodiments, either or both of the cartridge 320 and the tube 332 may be concentric with the housing 310. The tube 332 may include a first inlet 334 that is configured to have the first liquid (e.g., water) drawn in therethrough from the internal volume of the housing 310. The tube 332 may also include a second inlet 336 that is coupled to and/or in fluid communication with a connecting member (e.g., a seat) 338. The first inlet 334 may be positioned proximate to a lower end of the housing 310 (e.g., within 1 cm or less from the lower end). The second inlet 336 may be positioned proximate to a lower end of the housing 310 (e.g., within the bottom half of housing 110). The connecting member 338 may be coupled to or integral with the housing 310 and/or the pump assembly 330 (e.g., via the tube 332).

Once the cartridge 320 has been inserted at least partially into the internal volume of the housing 310 through the opening in the lid 312, a lower end of the cartridge 320 may be received into the connecting member 338. The lower end of the cartridge 320 may be coupled to the connecting member 338 via a friction fit, a spring-assisted friction fit, snap geometry (e.g., a bead, a nesting hemisphere, etc.), a thread or bayonet-style turn-to-lock feature, or a combination thereof. This may form a seal between the cartridge 320 and the connecting member 338.

In operation, a user may actuate (e.g., press down on) the pump assembly 320, causing the first liquid (e.g., water) in the internal volume of the housing 310 to be drawn into the tube 332 through the first inlet 334 of the tube 332. The actuation of the pump assembly 330 may also cause the second liquid (e.g., concentrated soap) in the cartridge 320 to be drawn into the tube 332 through the second inlet 336 of the tube 332. More particularly, the second liquid (e.g., concentrated soap) may flow from the cartridge 320, through the connecting member 338, and into the second inlet 336 of the tube 332 where the second liquid may be combined and/or mixed with the first liquid (e.g., water) to form a mixture in the tube 332. In at least one embodiment, the first inlet 334 may include a valve that prevents the second liquid from flowing out therethrough and mixing with the first liquid in the housing 310. The mixture may be ejected from the dispenser 300 through the outlet 340 of the pump assembly 330. In one embodiment, the mixture may be transformed into a foam as the mixture is ejected, thereby forming a foaming hand soap.

When the first liquid (e.g., water) in the housing 310 is exhausted, the user may decouple the lid 312 from the housing 310 and pour additional first liquid (e.g., water) into the internal volume housing 310. Alternatively, the user may remove the cartridge 320 from the housing 310 and pour additional first liquid (e.g., water) into the internal volume of the housing 310 through the opening 313 in the lid 312 where the cartridge 320 was positioned. The housing 310 may include a marking 342 that indicates the maximum fill level in the housing 310. The user may then re-couple the lid 312 to the housing 310 and/or re-insert the cartridge 320 back into the internal volume of the housing 320 through the opening 313 in the lid 312. In another embodiment, the user may refill the dispenser 300 with the first liquid (e.g., water) when the first liquid is only partially used up (i.e., there is still enough water in the housing 310 for the dispenser 300 to operate).

When the second liquid (e.g., concentrated soap) in the cartridge 320 is at least partially exhausted, the user may decouple the cartridge 320 from the lid 312 and/or from the connecting member 338. The cartridge 320 may then be removed/withdrawn from the internal volume of the housing 320. The cartridge 320 may include a valve 322 that prevents the second liquid (e.g., concentrated soap) from flowing out of the cartridge 320 and mixing with the first liquid (e.g., water) in the internal volume of the housing 310 when the cartridge 320 is removed from the connecting member 338.

The cartridge 320 may either be discarded or refilled with additional second liquid (e.g., concentrated soap). A new cartridge (or the refilled cartridge) 320, containing the second liquid (e.g., concentrated soap), may have a seal that prevents the concentrated soap from leaking out. The seal may be positioned proximate to the lower end of the cartridge 320 (e.g., proximate to the valve 322). The seal may be, for example, a snap off portion created by the blow/fill/seal process, a lidding film, a sticker, a plug, a screw cap, a snap cap, a valve, or a combination thereof. The new or refilled cartridge 320 may then be inserted at least partially into the housing 310 through the opening 313 in the lid 312. The seal may be removed prior to the insertion or upon contact with the connecting member 338. Once the cartridge 320 is coupled to the lid 312 and/or the connecting member 338 and in fluid communication with the second inlet 336 of the tube 332, the dispenser 300 may then once again be ready for use. In another embodiment, the user may refill or replace the cartridge 320 when the second liquid (e.g., concentrated soap) is only partially used up (i.e., there is still enough concentrated soap in the cartridge 320 for the dispenser 300 to operate).

Figure 5:
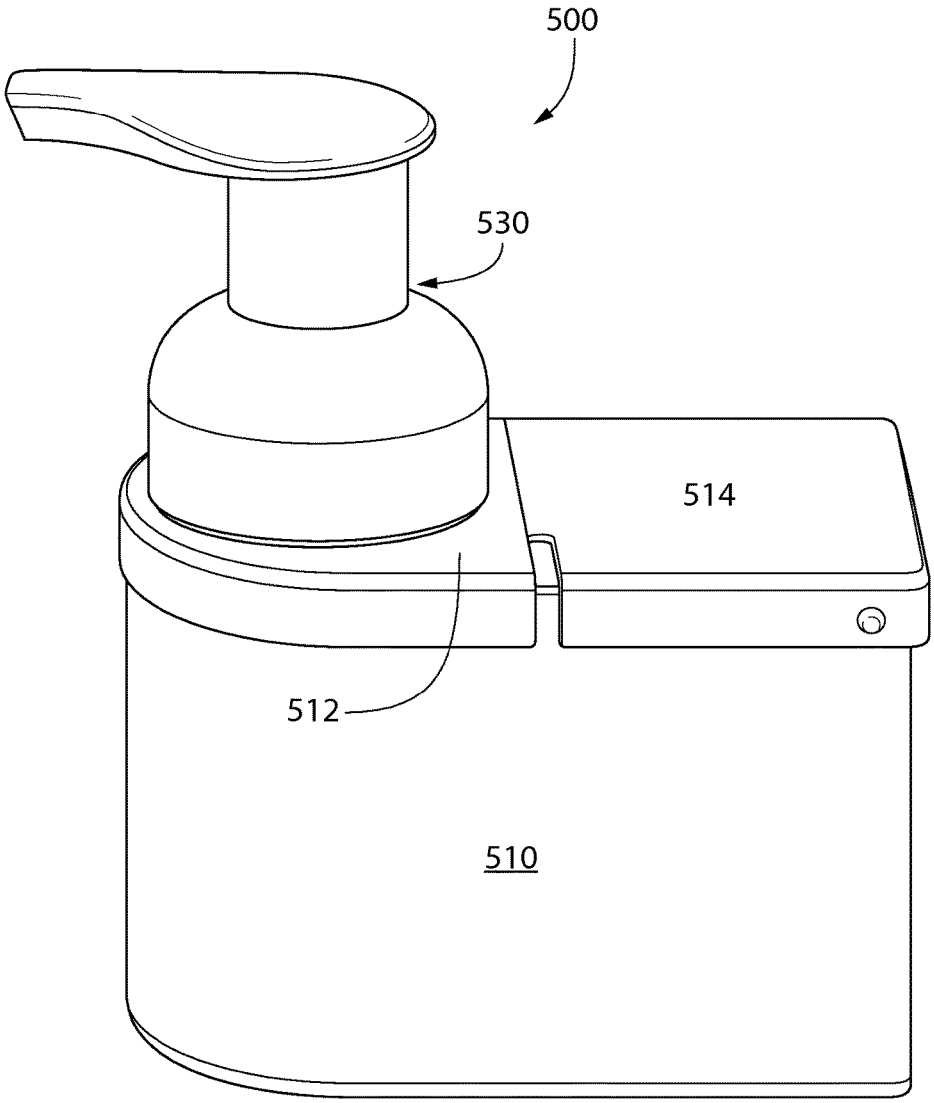
FIG. 5 depicts a perspective view of an example of another dispenser including a housing, a cartridge, and a pump assembly.
Figure 6:
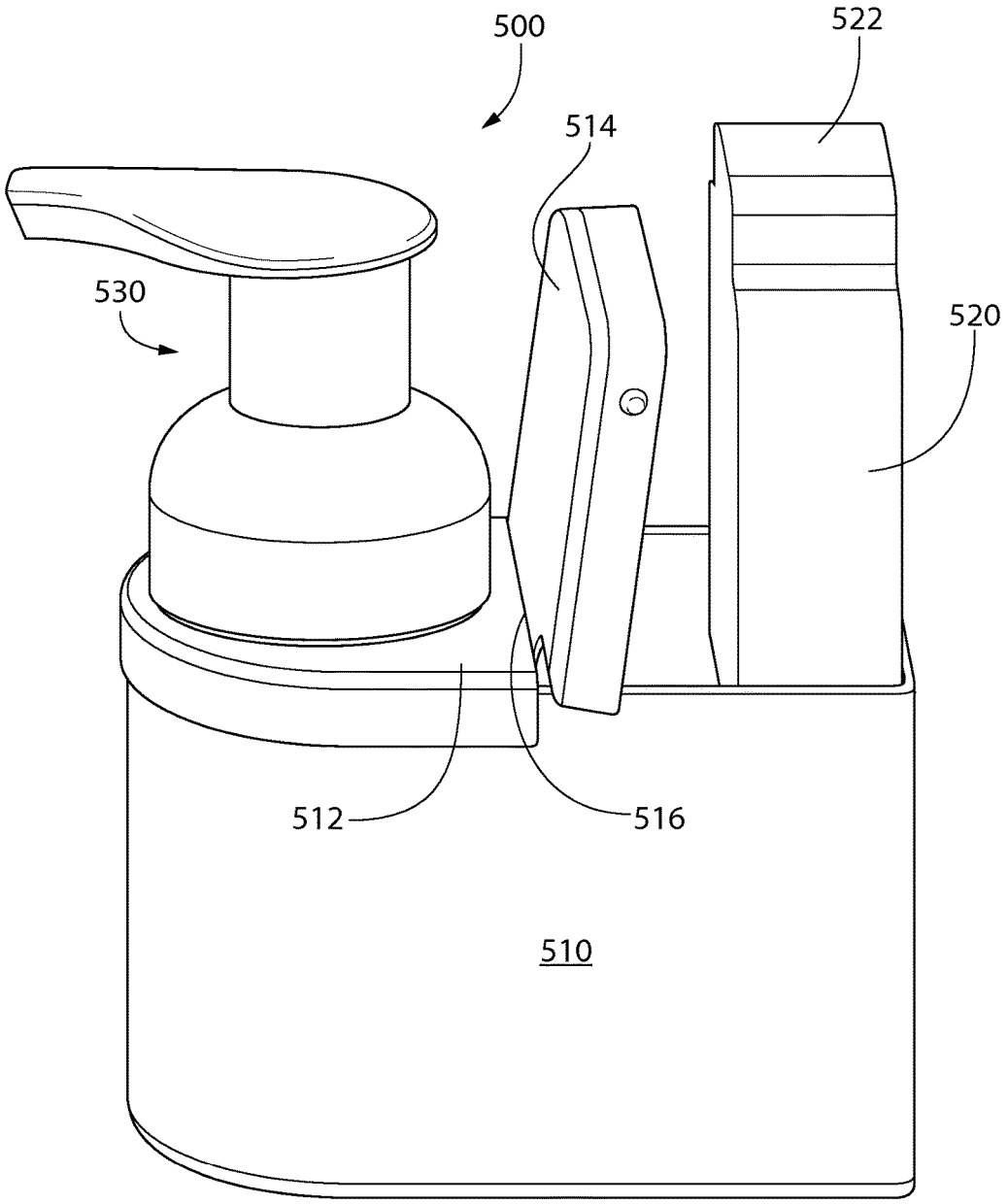
FIG. 6 depicts a perspective view of the dispenser of FIG. 5 showing the cartridge being inserted into the housing.

FIG. 5 depicts a perspective view of an example of another dispenser 500 including a housing 510, a cartridge 520, and a pump assembly 530, and FIG. 6 depicts a perspective view of the dispenser 500 of FIG. 5 showing the cartridge 520 being inserted into the housing 510. The dispenser 500 may be similar to the dispensers 100, 300, and a discussion of similar components is omitted.

Rather than have the cartridge 520 be inserted into the internal volume of the housing 510 through an opening in the lid 512, as in FIGS. 1-4, a portion of the lid 514 may be moved or removed while the remainder of the lid 512 remains in place. As shown, the portion of the lid 514 may be configured to pivot or rotate about a hinge 516 with respect to the remainder of the lid 512 between a closed position (FIG. 5) and an open position (FIG. 6). When the portion of the lid 514 is in the open position, the cartridge 520 may be inserted into the internal volume of the housing 510 and/or removed from the internal volume of the housing 510.

The cross-sectional shape of the cartridge 520 may be substantially rectangular. The cartridge 520 may be symmetrical about a vertical plane so it may be inserted into the housing 320 in one of two orientations 180 degrees opposed from each other. An upper end 522 of the cartridge 520 may have a profile that is configured to engage the underside of the portion of the lid 514 when the portion of the lid 514 is in the closed position. This may secure the cartridge 520 in place within the internal volume of the housing 510. In at least one embodiment, when the pump assembly 530 is screwed into the lid 512, this threaded closure may serve to keep the lid 514 closed, and in turn secure the cartridge 520 in place within the internal volume of the housing 510.

Figure 7:
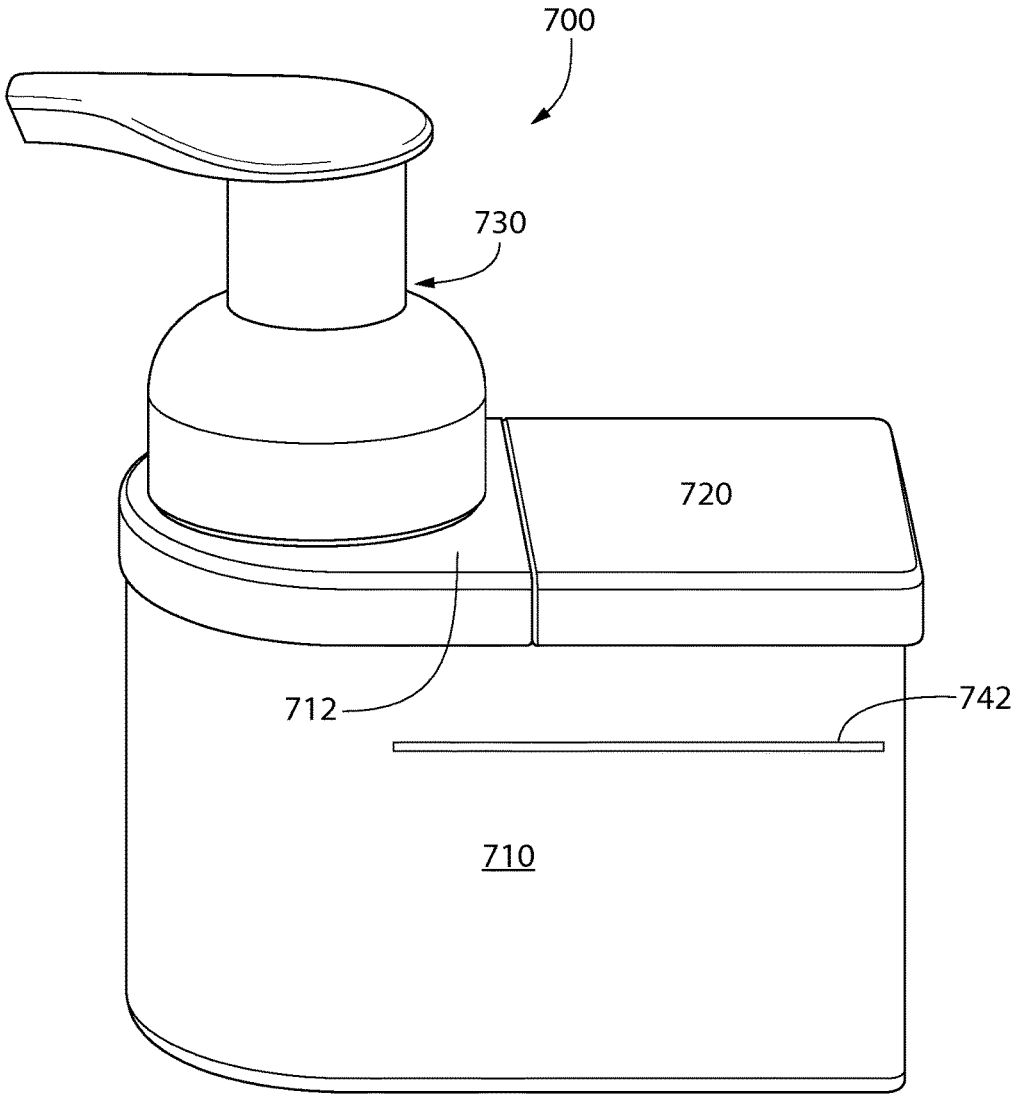
FIG. 7 depicts a perspective view of an example of another dispenser including a housing, a cartridge, and a pump assembly.
Figure 8:
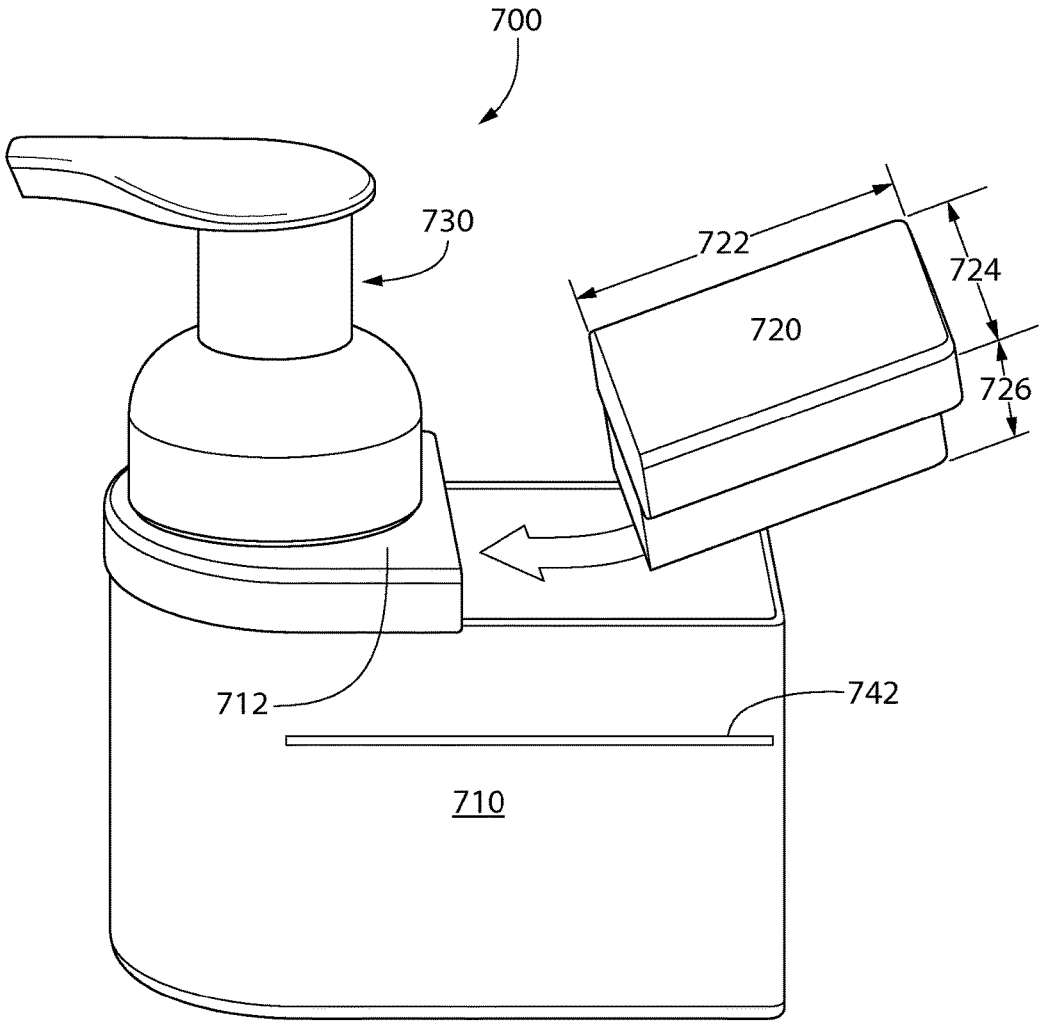
FIG. 8 depicts a perspective view of the dispenser of FIG. 7 showing the cartridge being inserted into the housing.

FIG. 7 depicts a perspective view of an example of another dispenser 700 including a housing 710, a cartridge 720, and a pump assembly 730, and FIG. 8 depicts a perspective view of the dispenser 700 of FIG. 7 showing the cartridge 720 being inserted into the housing 710. The dispenser 700 may be similar to the dispensers 100, 300, 500, and a discussion of similar components is omitted.

Rather than have a portion of the lid be moved or removed to insert and/or remove the cartridge 720 from the internal volume of the housing 710, as in FIGS. 5 and 6, the cartridge 720 may serve as a portion of the lid 712. The first liquid (e.g., water) may be poured into the internal volume of the housing 710 before the cartridge 720 is coupled to the housing 710. Once the first liquid (e.g., water) has been poured into the internal volume, the cartridge 720 may be inserted into the upper end of the housing 710 in a substantially horizontal direction, as shown by the arrow in FIG. 8. The cartridge 720 may be coupled to the housing 710 and/or the lid 712 via a friction fit, a spring-assisted friction fit, snap geometry (e.g., a bead, a nesting hemisphere, etc.), a thread or bayonet-style turn-to-lock feature, or a combination thereof. In at least one embodiment, a seal may positioned between the housing 710 and the cartridge 720 and/or between the lid 712 and the cartridge 720 to form a liquid-tight seal between the two components. In at least one embodiment, when the pump assembly 730 is screwed into the lid 712, this threaded closure may serve to secure the cartridge 720 in place partially within the internal volume of the housing 710.

The length 722 and/or the width 724 of the cartridge 720 may be greater than the height/depth 726 of the cartridge 720. This shape of the cartridge 720 may allow the concentrated soap to be distributed laterally within the cartridge 720, thus allowing the underside of the cartridge 720 to be mounted higher with respect to the tube of the pump assembly 730. This, in turn, allows the second liquid (e.g., concentrated soap) to be introduced into the tube of the pump assembly 730 at a higher point in the tube (e.g., later in the pump flow). As a result, when the cartridge 720 is refilled or replaced, fewer actuations of the pump assembly 730 are needed to flush the residual second liquid (e.g., concentrated soap) out of the pump assembly 730, and the user experiences the new second liquid (e.g., concentrated soap) mixture sooner. The high mounting of the cartridge 720 also allows it to be seated within housing 710 with its underside positioned above the marking 742 for maximum fill level of first liquid (e.g., water), thus preventing the cartridge 720 from coming into contact with the first liquid (e.g., water) during normal operation.

The second liquid (e.g., concentrated soap) may be evacuated from the underside of the cartridge 720 with the assistance of gravity. The cartridge 720 may include a valve, similar to the valve 322 discussed above. Just before the cartridge 720 bottoms out within the housing 710, the valve may connect to the tube of the pump assembly 730 to allow the concentrated soap to flow into the tube of the pump assembly 730. When the cartridge 720 is removed from the housing 710, the valve may prevent the concentrated soap from flowing out of the cartridge 720.

Figure 9:
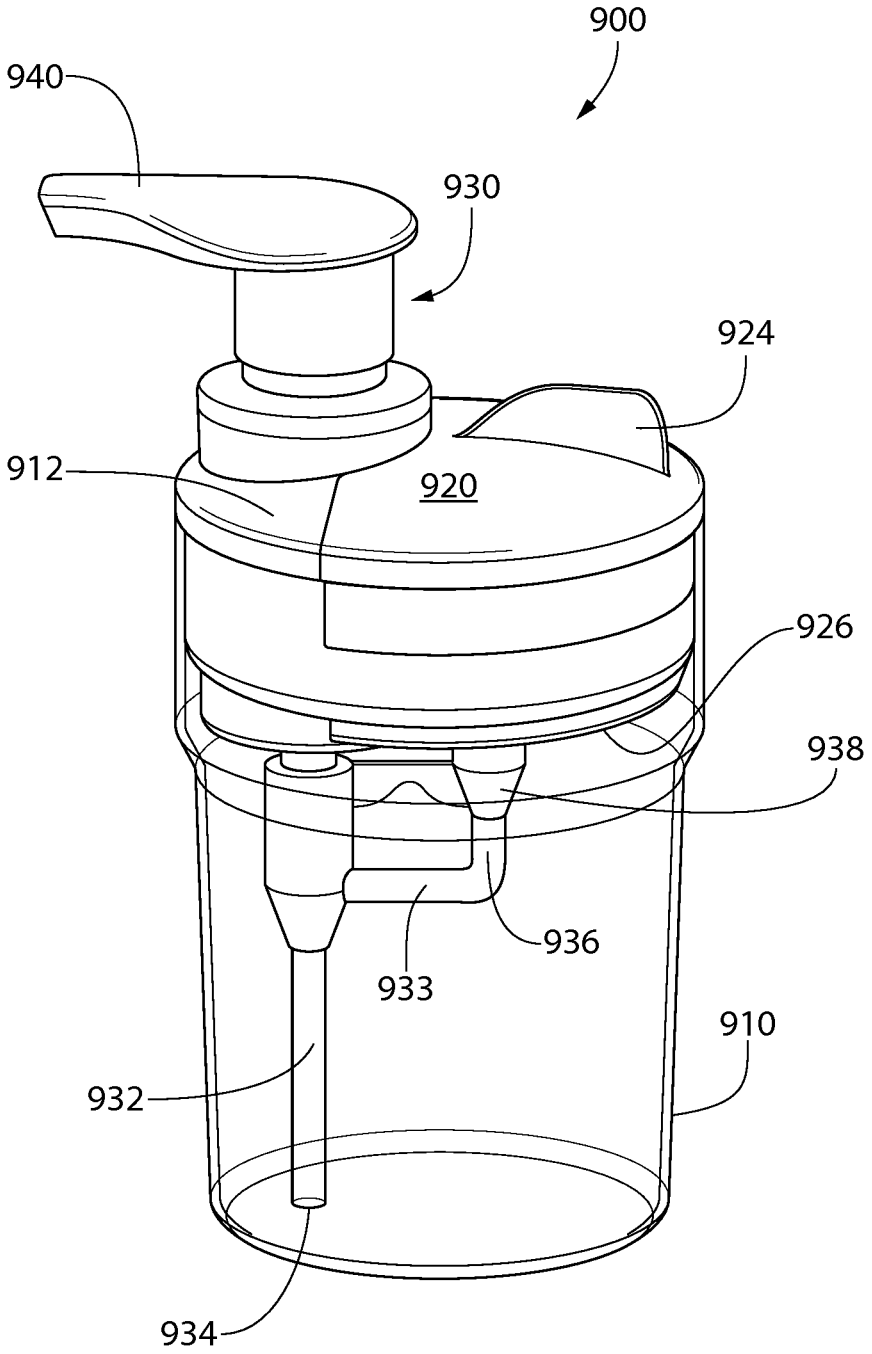
FIG. 9 depicts a perspective view of an example of another dispenser including a housing, a cartridge, and a pump assembly.
Figure 10:
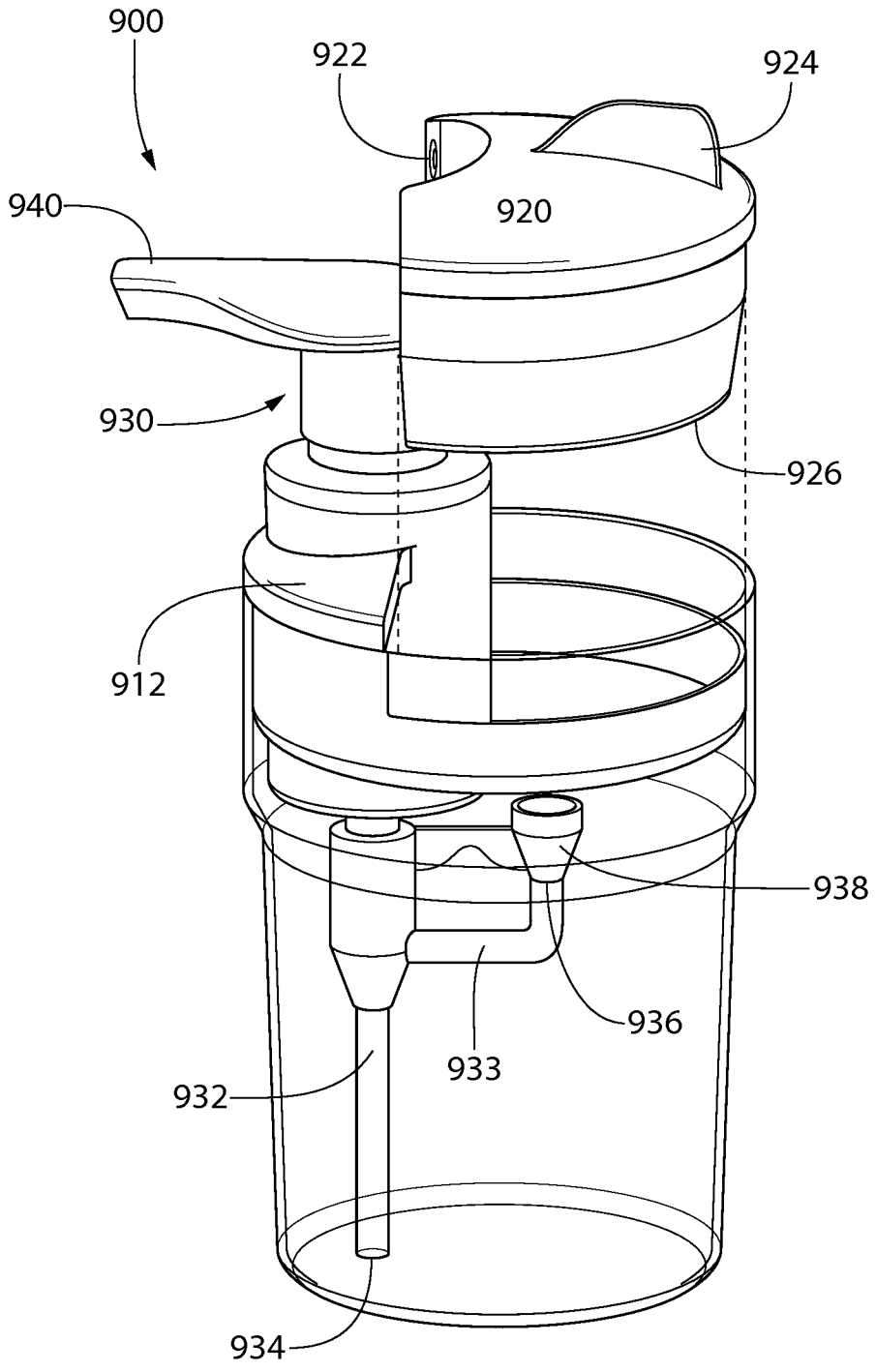
FIG. 10 depicts a perspective view of the dispenser of FIG. 9 showing the cartridge being inserted into the housing.

FIG. 9 depicts a perspective view of an example of another dispenser 900 including a housing 910, a cartridge 920, and a pump assembly 930, and FIG. 10 depicts a perspective view of the dispenser 900 of FIG. 9 showing the cartridge 920 being inserted into the housing 910. In the embodiment shown, the housing 910 may have a substantially circular cross-sectional shape. In addition, the housing 910 may be at least partially transparent or opaque.

The cartridge 920 may have a partially circular cross-sectional shape. For example, the cross-sectional shape of the cartridge 920 may be a half-circle. In another embodiment, the cross-sectional shape of the cartridge 920 may be a portion of a ring. This shape of the cartridge 720 may allow the concentrated soap to be distributed laterally within the cartridge 920, thus allowing the underside of the cartridge 920 to be mounted higher with respect to the tube 932. This, in turn, allows the concentrated soap to be introduced into the tube 932 at a higher point in the tube 932 (e.g., later in the pump flow). As a result, when the cartridge 920 is refilled or replaced, fewer actuations of the pump assembly 930 are needed to flush the residual second liquid (e.g., concentrated soap) out of the pump assembly 930, and the user experiences the new concentrated soap mixture sooner.

The cartridge 920 may also include a protrusion 924 that the user may grip when inserting and removing the cartridge 920. The cartridge 920 may include an opening 922. The opening 922 may be used to fill or refill the cartridge 920. Optionally, the cartridge 920 may have a venting system that allows the intake of air in to neutralize any vacuum created by the outflow of concentrate. The vent may be sealed by the same devices or processes listed above. The cartridges 120, 320, 520 discussed above may have a similar venting system.

The pump assembly 930 may include a tube 932 that extends into the internal volume of the housing 910. As shown, neither the cartridge 920 nor the tube 932 may be concentric with the housing 910 or the lid 912; however, in other embodiments, the tube 932 may be concentric with the housing 910. The tube 932 may include a first inlet 934 that is configured to have the first liquid (e.g., water) drawn in therethrough from the internal volume of the housing 910. The tube 932 may be coupled to, integral with, and/or in fluid communication with a tube 933. The tube 933 may include a second inlet 936 that is coupled to and/or in fluid communication with a connecting member (e.g., a seat) 938. The first inlet 934 may be positioned proximate to a lower end of the housing 310 (e.g., within 1 cm or less from the lower end), while the second inlet 936 may be positioned proximate to an upper end of the housing 910 where the cartridge 920 is positioned. The connecting member 938 may be coupled to or integral with the housing 910 and/or the pump assembly 930 (e.g., via the tube 933).

Once the cartridge 920 has been coupled to the housing 910 and/or the lid 912, an underside 926 of the cartridge 320 may be received into the connecting member 938. The underside 926 of the cartridge 920 may be coupled to the connecting member 938 via a friction fit, a spring-assisted friction fit, snap geometry (e.g., a bead, a nesting hemisphere, etc.), a thread or bayonet-style turn-to-lock feature, or a combination thereof. This may form a seal between the cartridge 920 and the connecting member 938.

In operation, a user may actuate (e.g., press down on) the pump assembly 920, causing the first liquid (e.g., water) in the internal volume of the housing 910 to be drawn into the tube 932 through the first inlet 934 of the tube 932. The actuation of the pump assembly 930 may also cause the second liquid (e.g., concentrated soap) in the cartridge 920 to be drawn into the tube 933 through the second inlet 936 of the tube 933. More particularly, the second liquid (e.g., concentrated soap) may flow from the cartridge 920, through the connecting member 938, and into the second inlet 936 of the tube 933 where the second liquid (e.g., concentrated soap) may be combined and/or mixed with the first liquid (e.g., water) to form a mixture in the tube 932. In at least one embodiment, the first inlet 934 may include a valve that prevents the second liquid (e.g., concentrated soap) from flowing out therethrough and mixing with the first liquid (e.g., water) in the housing 910. The mixture may be ejected from the dispenser 900 through the outlet 940 of the pump assembly 930. In one embodiment, the mixture may be transformed into a foam as the mixture is ejected, thereby forming a foaming hand soap.

When the first liquid (e.g., water) in the housing 910 is exhausted, the user may decouple the lid 912 from the housing 910 and pour additional first liquid (e.g., water) into the internal volume housing 910. Alternatively, the user may remove the cartridge 920 from the housing 910 and pour additional first liquid (e.g., water) into the internal volume of the housing 910 through the opening 913 in the lid 912 where the cartridge 920 was positioned. The housing 910 may include a marking that indicates the maximum fill level in the housing 910. The user may then re-couple the lid 912 to the housing 910 and/or re-insert the cartridge 920 back into the internal volume of the housing 920 through the opening 913 in the lid 912. In another embodiment, the user may refill the dispenser 900 with the first liquid (e.g., water) when the first liquid (e.g., water) is only partially used up (i.e., there is still enough water in the housing 910 for the dispenser 900 to operate).

When the second liquid (e.g., concentrated soap) in the cartridge 920 is at least partially exhausted, the user may decouple the cartridge 920 from the housing 910, the lid 912, and/or the connecting member 938. The cartridge 920 may then be removed/withdrawn from the internal volume of the housing 920. The cartridge 920 may include a valve 922 that prevents the second liquid (e.g., concentrated soap) from flowing out of the cartridge 920 and mixing with the first liquid (e.g., water) in the internal volume of the housing 910 when the cartridge 920 is removed from the connecting member 938.

The cartridge 920 may either be discarded or refilled with additional second liquid (e.g., concentrated soap). A new cartridge (or the refilled cartridge) 920, containing second liquid (e.g., concentrated soap), may have a seal that prevents the second liquid (e.g., concentrated soap) from leaking out. The seal may be positioned proximate to the lower end of the cartridge 920 (e.g., proximate to the valve 922). The seal may be, for example, a snap off portion created by the blow/fill/seal process, a lidding film, a sticker, a plug, a screw cap, a snap cap, a valve, or a combination thereof. The new or refilled cartridge 920 may then be inserted at least partially into the housing 910 through the opening 913 in the lid 912. The seal may be removed prior to the insertion or upon contact with the connecting member 938. Once the cartridge 920 is coupled to the lid 912 and/or the connecting member 938 and in fluid communication with the second inlet 936 of the tube 933, the dispenser 900 may then once again be ready for use. In another embodiment, the user may refill or replace the cartridge 920 when the second liquid (e.g., concentrated soap) is only partially used up (i.e., there is still enough concentrated soap in the cartridge 920 for the dispenser 900 to operate).

What is claimed is:

1. A dispenser, comprising:

a housing defining an internal volume, wherein a first liquid is disposed within the internal volume of the housing;

a cartridge coupled with the housing, wherein the cartridge comprises a lower portion, and wherein a second liquid is disposed within the cartridge;

a pump assembly comprising a tube, the tube extending into the internal volume of the housing, wherein the first liquid is drawn from the internal volume into the tube through a first inlet in the tube when the pump assembly is actuated;

a connecting member positioned in the internal volume of the housing, wherein the lower portion of the cartridge is fluidly coupled to the connecting member, wherein a second inlet of the tube is fluidly coupled to the connecting member, and wherein the second liquid is drawn from the cartridge, through the connecting member, and into the tube through the second inlet when the pump assembly is actuated; and a lid coupled to an upper end of the housing, wherein the tube extends through a first opening in the lid, and the cartridge extends through a second opening in the lid.

2. The dispenser of claim 1, wherein no tube extends at least partially through the cartridge.

3. The dispenser of claim 1, wherein neither the tube nor the cartridge is concentric with the housing.

4. The dispenser of claim 1, wherein the cartridge comprises a valve that prevents the second liquid from flowing out of the cartridge when the cartridge is decoupled from the connecting member.

5. The dispenser of claim 1, wherein the connecting member is coupled to a bottom of the housing.

6. The dispenser of claim 1, wherein the first liquid comprises water, wherein the second liquid comprises concentrated soap, and wherein the first liquid and the second liquid are combined inside the tube to form a mixture.

7. The dispenser of claim 6, wherein the mixture is ejected from the pump assembly as a foaming hand soap.

8. The dispenser of claim 1, wherein the connecting member is positioned within a lower portion of the housing.

9. The dispenser of claim 1, wherein the cartridge is positioned at least partially within the connecting member.

10. A dispenser, comprising:

a housing defining an internal volume, wherein the housing comprises a housing lower portion, and wherein a first liquid is disposed within the internal volume of the housing;

a cartridge coupled with the housing, wherein the cartridge comprises a cartridge lower portion, and wherein a second liquid is disposed within the cartridge;

a pump assembly comprising a tube, the tube extending into the internal volume of the housing, wherein the tube comprises a T-shaped joint positioned in the housing lower portion, and wherein the first liquid is drawn from the internal volume into the tube through a first inlet in the tube when the pump assembly is actuated;

a connecting member positioned in the housing lower portion, wherein the cartridge lower portion is fluidly coupled to the connecting member, wherein a second inlet of the tube is fluidly coupled to the connecting member, and wherein the second liquid is drawn from the cartridge, through the connecting member, and into the tube through the second inlet when the pump assembly is actuated; and a lid coupled to an upper end of the housing, wherein the tube extends through a first opening in the lid, and the cartridge is coupled to the lid.

11. The dispenser of claim 10, wherein neither the tube nor the cartridge is concentric with the housing.

12. The dispenser of claim 10, wherein the first liquid comprises water, wherein the second liquid comprises concentrated soap, and wherein the first liquid and the second liquid are combined inside the tube to form a mixture.

13. The dispenser of claim 10, wherein the T-shaped joint comprises:

a first side comprising the first inlet;

a second side comprising the second inlet; and a third side extending upwardly toward an outlet of the tube.

14. The dispenser of claim 10, wherein the first liquid and the second liquid are combined in the T-shaped joint.

15. A method for using a dispenser, comprising:

pouring a first liquid into an internal volume of a housing;

inserting a tube of a pump assembly into the internal volume of the housing, wherein the tube includes a first inlet and a second inlet that are positioned in the internal volume of the housing, the housing comprising a lid coupled to an upper end of the housing, wherein the tube extends through the lid;

coupling a cartridge with the housing, wherein a second liquid is disposed in the cartridge, wherein the cartridge is at least partially inserted into the lid; and coupling a lower portion of the cartridge to a connecting member that is positioned within the internal volume of the housing, wherein the connecting member is positioned between the second inlet of the tube and the cartridge.

16. The method of claim 15, further comprising actuating the pump assembly, thereby causing:

the first liquid to be drawn from the internal volume into the tube through the first inlet in the tube; and the second liquid to be drawn from the cartridge, through the connecting member, and into the tube through the second inlet in the tube, wherein the first liquid and the second liquid are combined inside the tube.

17. The method of claim 16, wherein the first liquid is poured into the internal volume of the housing through an opening in the lid.

18. The method of claim 17, further comprising:

removing the cartridge from the internal volume of the housing;

pouring additional first liquid into the internal volume of the housing after the cartridge has been removed; and re-inserting the cartridge at least partially into the internal volume of the housing after the additional first liquid has been poured into the internal volume of the housing.

19. The method of claim 17, further comprising: removing the cartridge from the internal volume of the housing; pouring additional second liquid into the cartridge; and re-inserting the cartridge at least partially into the internal volume of the housing after the additional second liquid has been poured into the cartridge.

* * * * *